US005152624A

United States Patent [19]

Buschmann et al.

[11] Patent Number: 5,152,624

[45] Date of Patent: Oct. 6, 1992

[54] PRINTER, IN PARTICULAR MATRIX PIN PRINTER

[75] Inventors: Ulrich Buschmann, Elchingen; Günter Gomoll, Nersingen/Leibi; Wolfgang Hauslaib, Langenau; Alfred Babsch; Alois Hoffart, both of Ulm; Werner Rupp, Nersingen, all of Fed. Rep. of Germany

[73] Assignee: Mannesmann Aktiengesellschaft, Düsseldorf, Fed. Rep. of Germany

[21] Appl. No.: 597,731

[22] Filed: Oct. 15, 1990

[30] Foreign Application Priority Data

Oct. 16, 1989 [DE] Fed. Rep. of Germany ..... 3934792

[51] Int. Cl.[5] ..... B41J 29/02

[52] U.S. Cl. ..... 400/691; 400/693; 400/88; 400/322; 361/394; 361/395; 361/397; 361/399

[58] Field of Search ..... 400/691, 692, 693, 694, 400/88, 322; 312/208; 174/35 R; 361/392, 393, 395, 397, 399, 400, 401, 404, 406, 415, 424, 331

[56] References Cited

U.S. PATENT DOCUMENTS

| | | | |
|---|---|---|---|
| 4,510,345 | 4/1985 | Costa et al. | 174/35 R |
| 4,527,285 | 7/1985 | Kekas et al. | 361/393 |
| 4,549,825 | 10/1985 | Fish, III et al. | 400/692 |
| 4,730,947 | 3/1988 | Ikeda et al. | 400/692 |
| 4,732,502 | 3/1988 | Youoi | 400/692 |
| 4,881,839 | 11/1989 | Grimm | 400/693 |
| 4,883,376 | 11/1989 | Iwase et al. | 400/691 |

FOREIGN PATENT DOCUMENTS

| | | | |
|---|---|---|---|
| 2136806 | 2/1973 | Fed. Rep. of Germany | 400/693 |
| 2203981 | 8/1973 | Fed. Rep. of Germany | 400/693 |
| 0019577 | 1/1985 | Japan | 400/693 |
| 0197682 | 8/1988 | Japan | 400/691 |
| 7407902 | 1/1975 | Netherlands | 400/693 |

OTHER PUBLICATIONS

"Typing Work Station Requiring Minimum Desk-Top Space" IBM Tech. Discl. Bulletin, vol. 31, No. 10 Mar. 1989 pp. 104-106.

*Primary Examiner*—Eugene H. Eickholt
*Attorney, Agent, or Firm*—Horst M. Kasper

[57] ABSTRACT

The print substrate support (3) and longitudinal guides (4) for a print-head slider (7) are disposed in parallel at the invention printer. A controllable paper-guide drive motor (10) is furnished for the paper guide (9; 9*a*) and a drive motor (11) is furnished for the print-head slider (7). In order to be able to economically produce printers for different paper widths, and in order to eliminate problems of interfering radiation, a separated space (14) is furnished at the end of the paper guide (9; 9*a*) or respectively, of the longitudinal guide (4). At least one control-logic printed circuit board (15), an interface printed circuit board (16), the paper-guide drive motor (10) as well as the print-head-slider drive motor (11) are disposed in the separated enclosed space (14).

33 Claims, 5 Drawing Sheets

PRINTER, IN PARTICULAR MATRIX PIN PRINTER

BACKGROUND OF THE INVENTION

1. Field of the Invention

The invention relates to a printer, and in particular to matrix pin printer with a frame. A print substrate support, extending in longitudinal direction, is disposed at the frame, and a longitudinal guide for a slider with a print head is disposed opposite and in parallel to the print substrate support. A paper guide is provided for individual sheets and/or for a continuous paper web. The paper guide and the print-head slider are drivable and controllable by way of drive motors. The frame is surrounded by a two-part or multiple-part plastic casing.

2. Brief Description of the Background of the Invention Including Prior Art

Such printers exhibit in most cases a metallic base frame and a two-part or multiple-part plastic casing. The printer width is determined according to the predetermined length of the print substrate support and by the path of the print head, which passes approximately over the full length of the print substrate support. This path is adapted to the printable width of the paper to be processed.

It is known from the German Patent Application Laid Out DE-B1-2,343,858 that the control electronics printed circuit board is disposed in a floor pan of the printer and that the drive motors for the print-head slider or, respectively, for the paper guide are disposed in their respective coordination relative to the respective drive component groups. This coordination is associated with disadvantages for two reasons. First, printers cannot be produced to employ alternatively paper of different widths. Second, there exists the difficulty that component groups, cycled with high frequencies, such as, for example, microprocessors, step electromotors and the like, emit undesirable electromagnetic interference radiations, which can be shielded individually only with difficulties and in a substantially uneconomical manner.

SUMMARY OF THE INVENTION

1. Purposes of the Invention

It is an object of the present invention to provide a printer of a simple and economical construction which operates alternatively with papers of different widths.

It is a further object of the present invention to provide a matrix printer construction which substantially shields against electromagnetic radiation emitted from high-frequency component groups.

It is yet another object of the present invention to furnish a matrix printer, which substantially separates the mechanical from the electrical components for easy servicing.

These and other objects and advantages of the present invention will become evident from the description which follows.

2. Brief Description of the Invention

According to a first embodiment, the present invention provides that the printer frame, following to the end of an elongated paper guide or, respectively, of an elongated print substrate support or, respectively, of the longitudinal guide for the print-head slider, forms a separated, substantially enclosed space. At least one printed circuit board for the electronics, an interface printed circuit board, and the paper-guide drive motor, as well as the print-head-slider drive motor, are disposed in said separated space. This construction is associated with the advantage that all lengths of the print substrate support, of the longitudinal guide, and of the guide rods and axles required for the longitudinal guide, can now be shortened or extended in a simple way in order to obtain a printer of a predetermined paper width, and production technology is thereby simplified. At the same time, there results in general the shortest possible connection lines among the electrical or, respectively, electronic component groups.

According to a second embodiment of the invention, all parts of the printer frame, with the exception of the metallic guide rods and axles, are produced of a synthetic plastic material and all electrical or, respectively, electronic components, as well as their connection elements, are disposed in a separated space. In addition to the already recited main advantages, the further advantage of an additional improvement in production technology results in a lower-cost production of the printer.

The two embodiments described above can be further improved by shielding the separated space with a sheet-metal casing for shielding the outside from emission of interfering electromagnetic radiation.

The invention structure can be further enhanced by furnishing a frame wall, made of electrically conductive plastic material, disposed facing toward the paper guide or, respectively, toward the print substrate support or, respectively, toward the longitudinal guide for the print-head slider. The guide rods, the axles, and the like, are electrically conductively supported in the frame wall. The print substrate support is also supported in the frame wall.

Additional improvements furnished by the invention provide that the space, shielded against interfering electromagnetic radiation, is subdivided into several levels. On one level there is furnished an interface printed circuit board and a control-logic printed circuit board, which are functionally connected by way of a connection plug. This results in advantages for the servicing of the printer, which advantages will become clearer in the following.

A service improvement and simplification comprises that the interface printed circuit board can be withdrawn or, respectively, can be reinserted along a lateral direction or, respectively, rearwardly along a guide.

A further simplification of the printer structure is achieved in that the paper-guide drive motor is supported at the frame wall made of an electrically conductive plastic.

A more favorable space subdivision of the separated space is further achieved in that the electrical connection line terminals for the paper-guide drive motor or, respectively, for the slider drive motor are guided to a printed circuit board for the power electronics, disposed in the area of the side wall of the separated space.

Furthermore, it is provided that the main power terminal part is disposed at the rear wall of the separated space. The main power terminal part is thus disposed outside of the paper guide path and is accessible easier than hitherto even in case of a pulled-in paper web.

The same advantage of having the connection line disposed outside of the paper sheet or paper web path during operation is achieved by having a plug-contact strip for the interface printed circuit board and a main power cable at the rear side of the separated space.

It is further advantageous that an operating field or key board is disposed on the side of the shielded space. With such a structure, there will result the shortest possible connection lines and supply lines.

According to a further feature of the invention, the keys of the operating keyboard are protruding through openings of the removable plastic casing.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
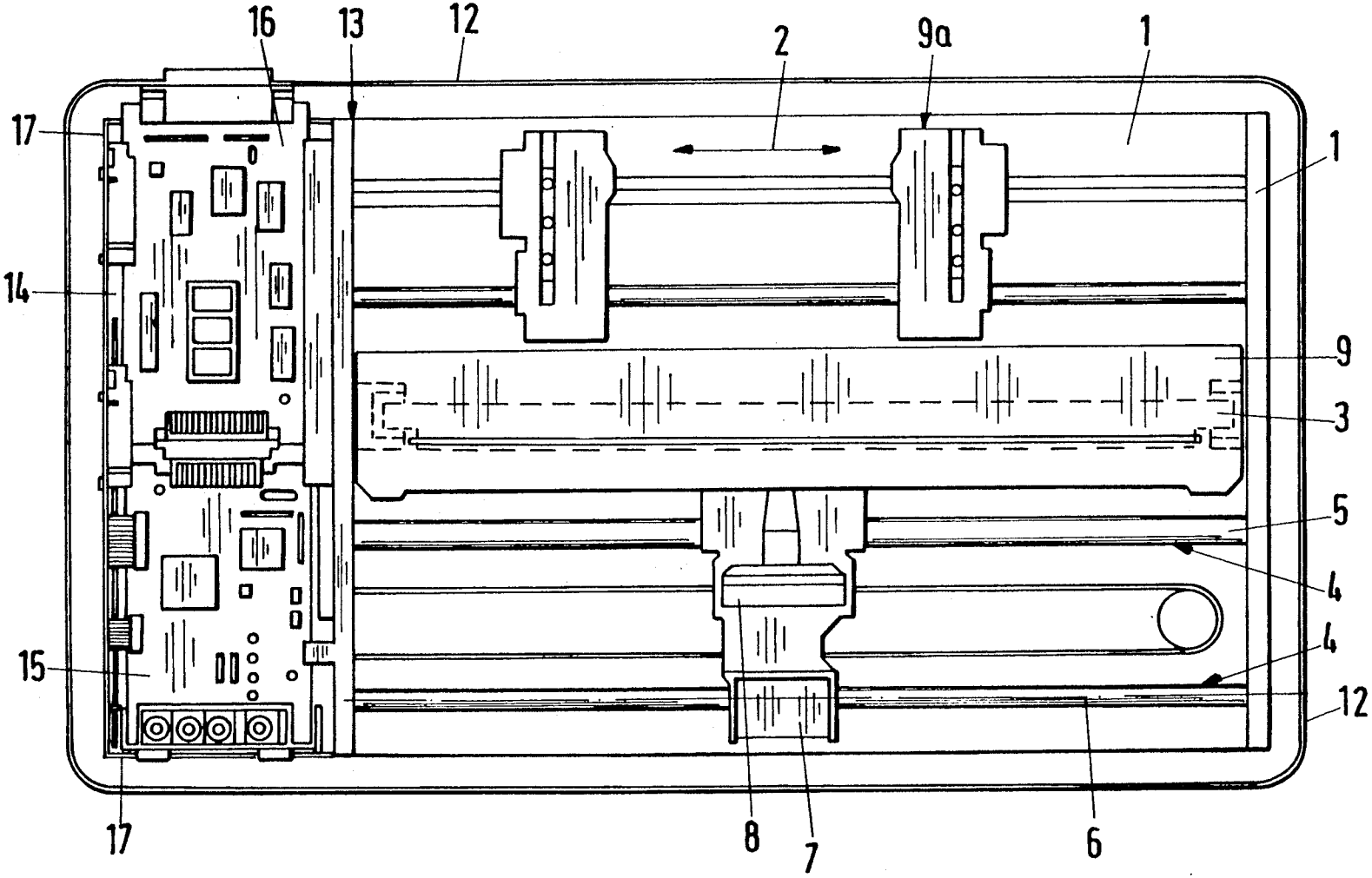
FIG. 1 is a top plan view onto a printer according to the invention where the upper part of the casing is removed.

The accompanying drawings are illustrating a serial matrix printer of the pin print head construction type. However, the invention can also be employed in many kinds of printers independent of the pin print principle. In particular, the invention can be employed with printers using a slider moving along a substrate.

The printer exhibits a frame 1 made of metal or of plastic. A print substrate support 3 and a longitudinal guide 4, disposed parallel and opposite to the print substrate support 3, are disposed at the frame 1 and extend in longitudinal direction 2. The longitudinal guide 4 comprises a guide rod 5 and an axle 6 for a print-head slider 7 including a print head 8. In addition, a paper guide 9 for individual sheets and such a paper guide **9*a* for a continuous paper web or sheet paper path is furnished. The paper guides 9 or, respectively, 9*a* can be driven and controlled by way of a paper-guide drive motor 10 and of a print-head-slider drive motor 11. The complete unit with the frame 1 is surrounded by a two-part plastic casing 12** which keeps dust and dirt away from the inner space and insulates printer noises from the inside toward the outside.

Following to the end 13 of the paper guides 9, **9*a* or, respectively following to the end of the print substrate support 3 or, respectively, of the longitudinal guide 4 for the print-head slider 7, the frame 1 is formed as a separated space 14. At least one control-logic printed circuit board 15, an interface printed circuit board 16, and the paper-guide drive motor 10, as well as the print-head-slider drive motor 11 are disposed in this special separated space 14**.

Figure 4:
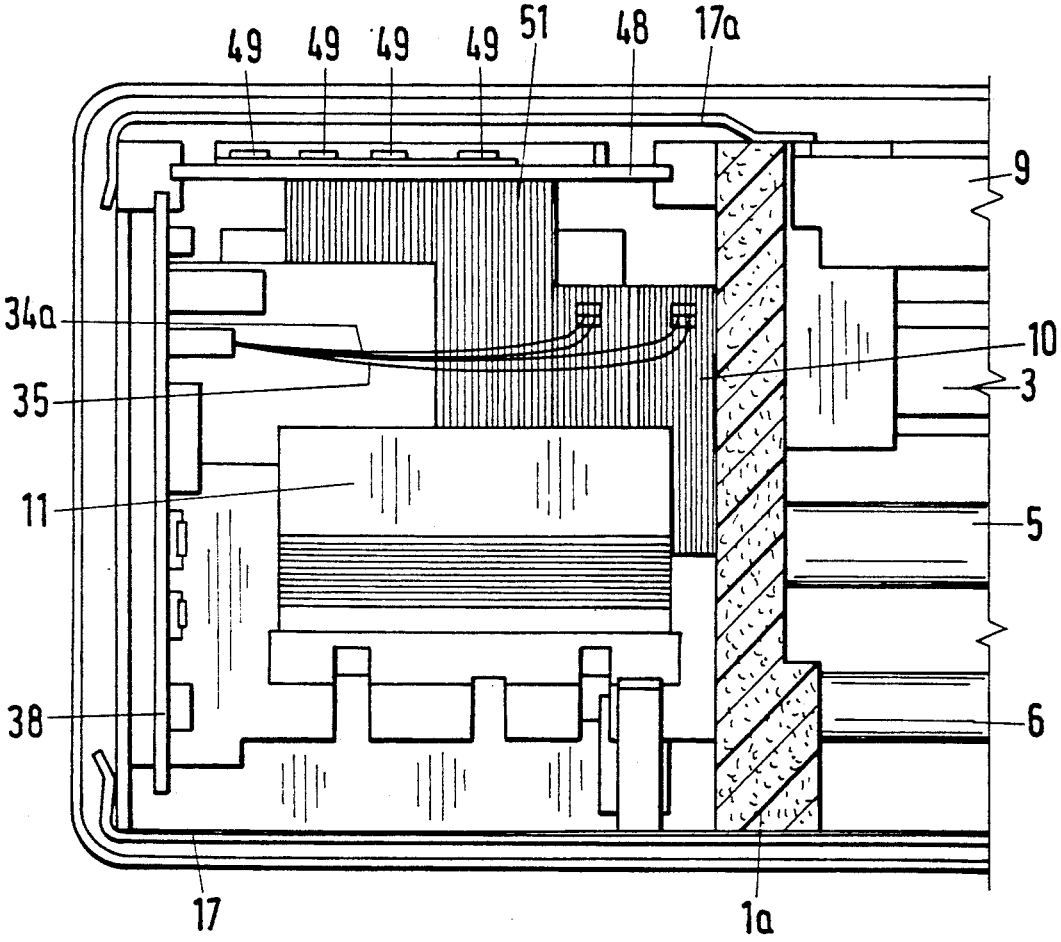
FIG. 4 is a vertical sectional view through the separated space illustrated in FIG. 2.

All parts of the frame 1, with the exception of the metallic guide rods 5 and the axles 6, are made of a moldable synthetic material or of a synthetic plastic which can be plastified. All electrical or, respectively, electronic device components and their connection elements are disposed in the separated enclosed space 14. The separated enclosed space 14 is surrounded by a sheet-metal casing 17. The sheet-metal casing 17 comprises advantageously a removable sheet-metal cover **17*a*, as illustrated in FIG. 4**.

Figure 2:
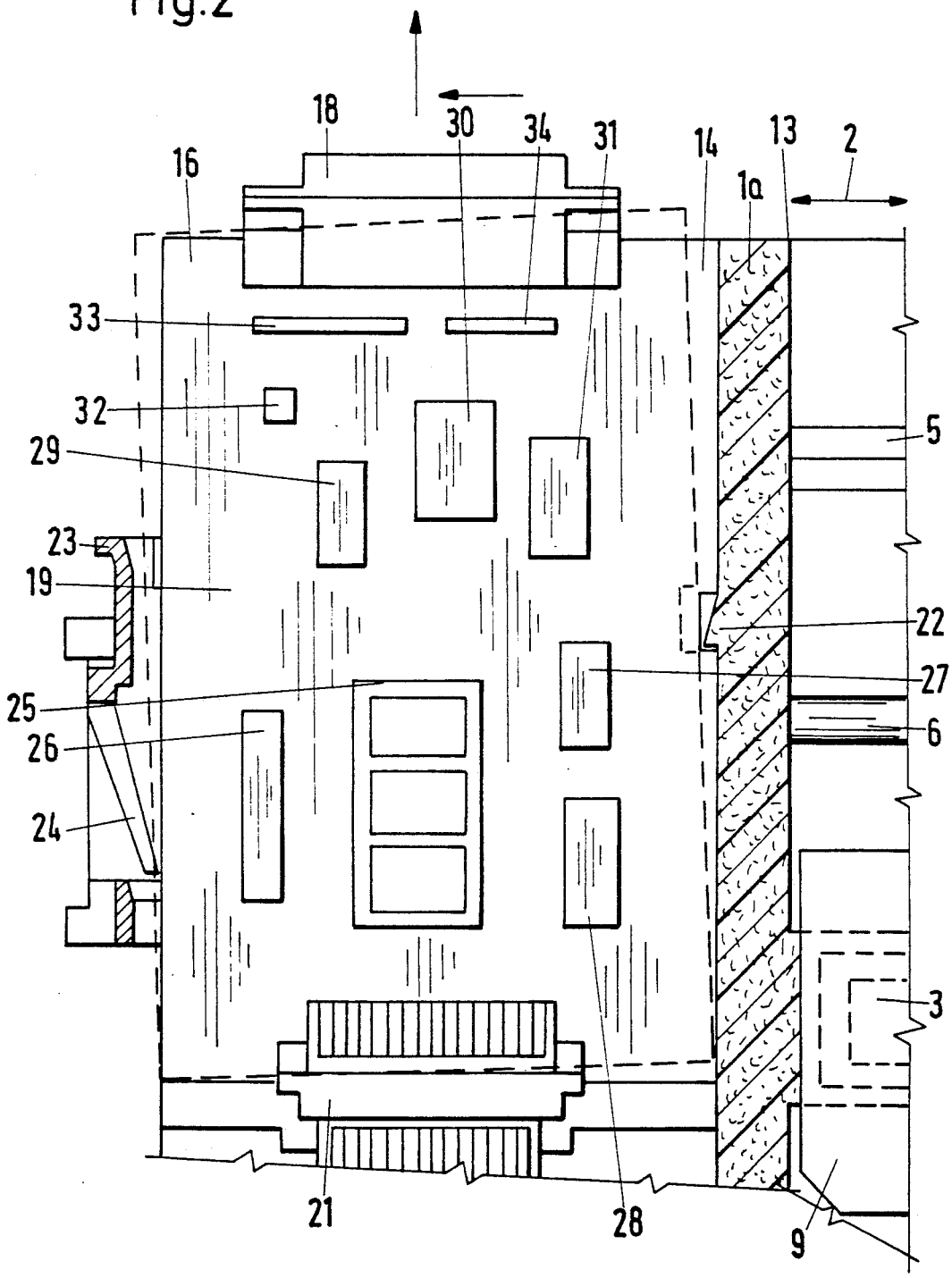
FIG. 2 is a top plan view onto the separated space in the rear region in an enlarged representation at the level of the interface printed circuit board.

As illustrated in FIG. 2, the interface printed circuit board 16, together with its plug contact strip 18, can be easily demounted and removed. A frame wall **1*a*, facing toward the paper guides 9, 9*a* or, respectively, the print substrate support 3 or, respectively, the longitudinal guide 4 for the print-head slider 7, is made of an electrically conductive plastic, such as a plastic comprising carbon fibers. The guide rod 5 and the axle 6 are electrically conductively supported in this frame wall 1*a*. The print substrate support 3 is also disposed in this frame wall 1*a***, which is made of an electrically conductively synthetic plastic. The electrical conductivity serves in this case for the discharge of electrostatic voltages which could affect the operating personnel.

Figure 3:
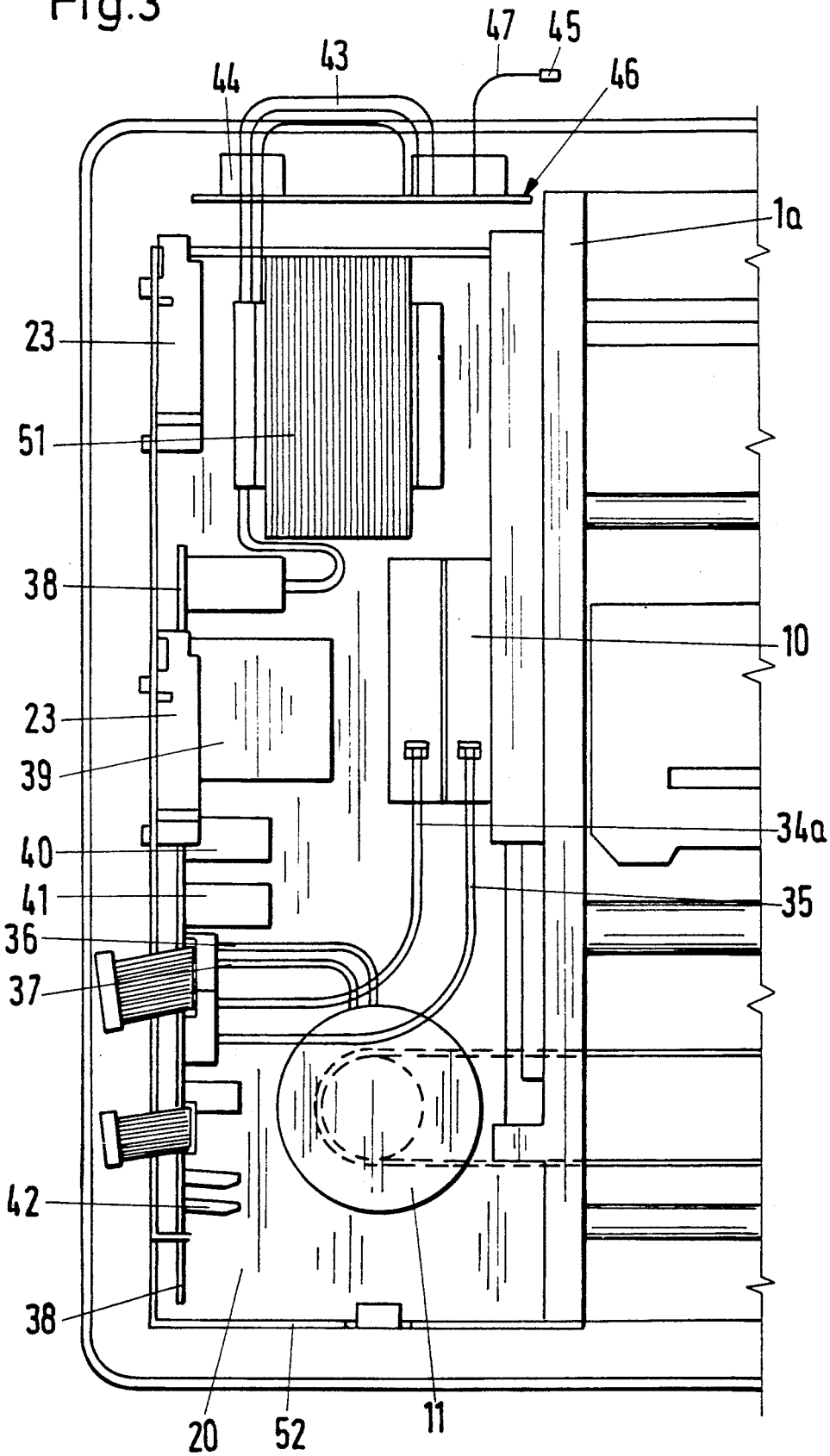
FIG. 3 is a top plan view onto the complete separated space at the level of the drive motors and of the grid connection part.

The separated enclosed space 14, shielding against interfering electromagnetic radiation, is subdivided into different levels 19 and 20. The upper level 19, as illustrated in FIG. 2, is formed by the printed circuit boards for the control logic 15 and for the interface 16. The lower level 20 is represented, amongst others, by the paper-guide drive motor 10 and the print-head-slider drive motor 11, as illustrated in FIG. 3. The control-logic printed circuit board 15 and the interface printed circuit board 16 are mechanically and electrically connected to each other by way of a connection plug 21, illustrated in FIG. 2.

The interface printed circuit board 16 can be pulled sideways toward the left first out of a catch 22 against a spring arm 24 and then out of the connection plug 21, as illustrated by a position shown as dashed lines in FIG. 2. The interface printed circuit board 16 can be further pulled out of a guide 23, which comprises the spring arm 24 for a disengageable clamping and interlocking. The interface printed circuit board 16 comprises device components such as, for example, an EPROM 25 which contains the control program. The remaining device components 26 through 34 form the required device modules for the interface functions.

The paper-guide drive motor 10 is supported at the frame wall **1*a*, furnished of an electrically conductive plastic, in the lower level 20, as illustrated in FIG. 3. The electrical connection line terminals 34*a* and 35 for the paper-guide drive motor 10 and the electrical conduction line terminals 36 and 37 are led to a printed circuit board 38 for the power electronics. This power-electronics printed circuit board 38, furnishing a power supply, is disposed outside at the separated space 14 below the sheet-metal casing 17. Device components, such as a capacitor 39, storage device modules 40, 41, driver device modules 42 and the like, are furnished at the printed circuit board 38**.

A main power connection 43, a power switch 44, and a power plug 45 are disposed at the rear wall side 46 of the separated space 14.

In addition, the plug-contact strip 18 for the interface printed circuit board 16 and the power cable 47 are disposed at the rear wall side 46 of the separated space 14 and are therefore all accessible even in case a paper web has been inserted into the printer.

An operating field or keyboard 48 is disposed on the side of the shielded, enclosed and separated space 14 such that the operating field or keyboard 48 can be disposed on the right or on the left at the printer.

The keys 49 of the keyboard 48 are led through openings 50 of the removable plastic casing 12 and protrude correspondingly. Even though a main power transformer 51, the paper-guide drive motor 10, and the print-head-slider driver motor 11, disposed in the lower level 20, as illustrated in FIG. 3, have to be considered as heat-loss generators, heat and thermal energy can be removed sufficiently by the highly thermally conductive sheet-metal casing 17 without forced ventilation to the surrounding outside of the plastic casing 12.

Figure 5:
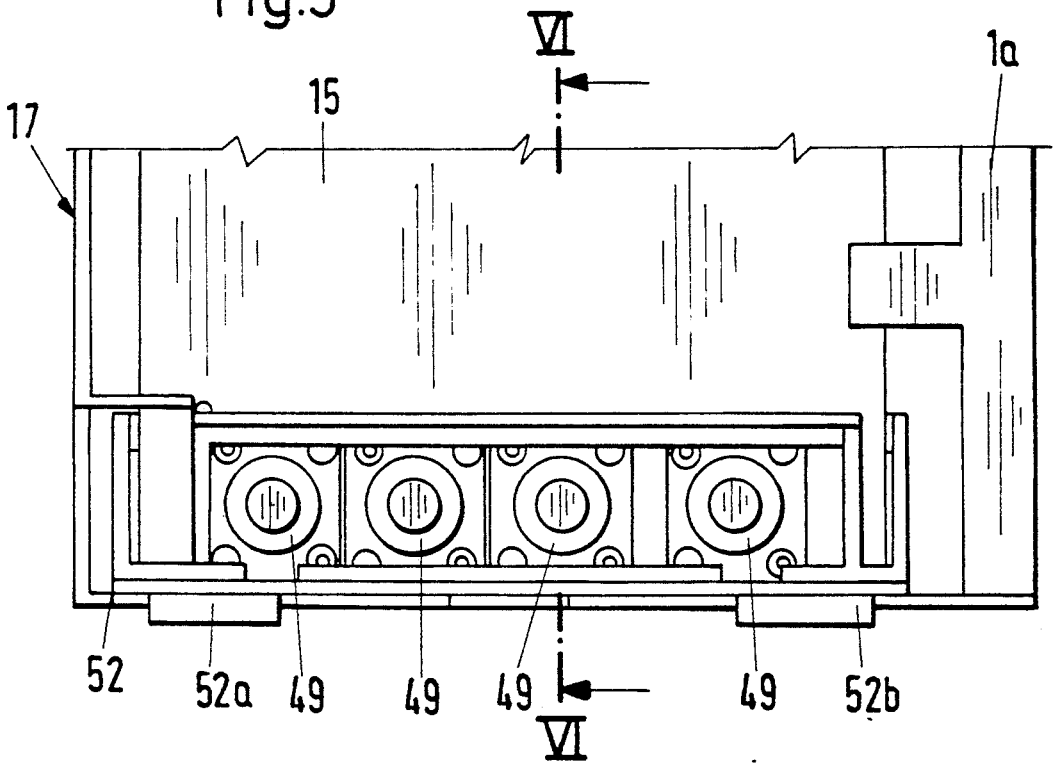
FIG. 5 is a top plan view onto the separated space in the region of the keyboard.
Figure 6:
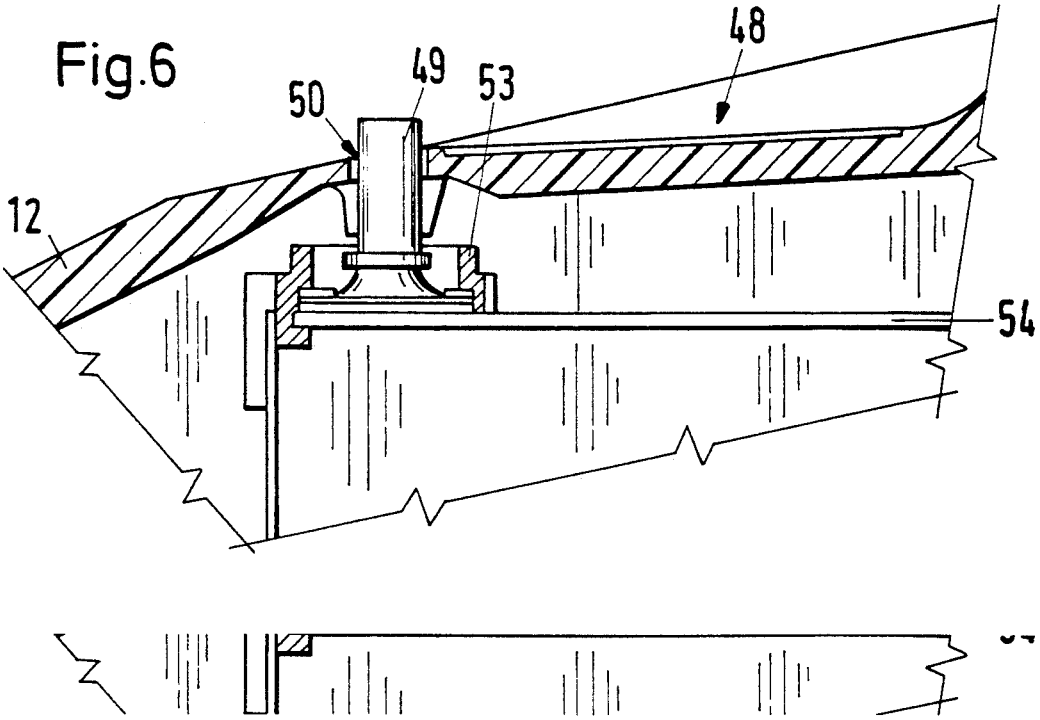
FIG. 6 is a partial sectional view according to the section line VI—VI according to FIG. 5.

The sheet-metal casing 17 is also furnished as a bottom panel, as illustrated in FIG. 4, and is in electrical and mechanical contact with the otherwise U-shaped sheet casing. The two arms of the U furnish the front side 52 and the rear wall side 46, as illustrated in FIG. 3. The sheet-metal casing 17 is furthermore furnished with bent protrusions 52*a* and 52*b*. In addition, the individual key device groups 53 as well as the support plate 54, receiving the keys, are shown in FIGS. 5 and 6.

It will be understood that each of the elements described above, or two or more together, may also find a useful application in other types of printing and paper-employing apparatus differing from the types described above.

While the invention has been illustrated and described as embodied in the context of a matrix pin printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A printer comprising a frame surrounded by a plastic casing;

a print substrate support disposed at the frame and extending in longitudinal direction;

a print head slider;

a longitudinal guide for said print head slider disposed opposite and parallel to the print substrate support;

a paper guide;

wherein the print substrate support, the print head slider, and the paper guide are driven and controlled with drive motors, and wherein the frame forms a separated enclosed space following to an end of the paper guide, and of the print substrate support, and of the longitudinal guide for the print head slider, wherein at least a control-logic printed circuit board, an interface printed circuit board, the paper guide drive motor, and the print head slider drive motor are disposed in said separated enclosed space.

2. The printer according to claim 1, wherein the plastic casing is a two-part plastic casing.

3. The printer according to claim 1, wherein the plastic casing is a multiple-part plastic casing.

4. The printer according to claim 1, wherein the paper guide is a single-sheet paper guide.

5. The printer according to claim 1, wherein the paper guide is a continuous-paper-web paper guide.

6. The printer according to claim 1, further comprising electronic device components;

wherein the frame and the print substrate support disposed at the frame are produced of moldable, plastifiable synthetic material, and wherein all electronic device components and their connection elements are disposed in the separated enclosed space.

7. The printer according to claim 6, further comprising a metallic axle supporting the print head slider a metallic guide rod supporting the print head slider and wherein the metallic axle and the metallic guide rod form the longitudinal guide.

8. The printer according to claim 1, wherein the print head slider supports a matrix print head.

9. The printer according to claim 1, wherein the separated enclosed space is shielded with a sheet-metal casing shielding to the outside against interfering electromagnetic radiation.

10. The printer according to claim 1, further comprising a frame side wall made of electrically conductive plastic and disposed facing toward the paper guide, the print substrate support, and the longitudinal guide for the print head slider, wherein guide rods and axles are electrically conductively supported in the frame wall, and wherein the print substrate support is supported in the frame wall.

11. The printer according to claim 1, wherein the separated enclosed space, shielded against interfering electromagnetic radiation, is subdivided into several levels, wherein the interface printed circuit board and the control-logic printed circuit board are disposed at one level, and wherein the interface printed circuit board and the control-logic printed circuit board are functionally connected by way of a connection plug.

12. The printer according to claim 11, wherein the interface printed circuit board can be removed and reinserted, respectively, in a sideways direction and in a rearward direction along a guide, respectively.

13. The printer according to claim 10, wherein the paper guide drive motor is supported at the frame side wall made of an electrically conductive plastic.

14. The printer according to claim 13, further comprising electrical connection terminals for the paper guide drive motor and for the print head slider drive motor, wherein said electrical connection terminals are lead to a power-electronics printed circuit board disposed in the area of the frame side wall of the separated enclosed space.

15. The printer according to claim 1, wherein a main power connection is disposed at a rear wall side of the separated enclosed space.

16. The printer according to claim 15, wherein a plug contact strip for the interface printed circuit board and a power-grid cable are disposed at the rear wall side of the separated enclosed space.

17. The printer according to claim 1, wherein a keyboard including keys is disposed on the side of the separated enclosed space, and wherein said keys protrude through openings of the removable plastic casing.

18. A printer including a frame;

a print substrate support extending in longitudinal direction and disposed at said frame, wherein a longitudinal guide for a print head slider is disposed opposite and parallel to said print slider is disposed opposite and parallel to said print substrate support, and including a paper guide, wherein the print head slider is controllable with a first drive motor and wherein the paper guide is drivable and controllable with a second drive motor;

a plastic casing surrounding the frame;

a metallic guide rod supporting the print head slider;

a metallic axle supporting the print head slider; wherein all parts of the printer frame (1), with the exception of the metallic guide rod (5) and of the axle (6), are produced of moldable, plastifiable synthetic material, and wherein all electronic device components and their connection elements are disposed in a separated enclosed space (14).

19. A printer including a frame, where a print substrate support, extending in longitudinal direction, is disposed at said frame, and where a longitudinal guide for a print head slider is disposed opposite and in parallel to said print substrate support, and including a paper guide, wherein in each case the print substrate support, the print head slider, and the paper guide are drivable and controllable with drive motors, wherein the frame is surrounded by a plastic casing, and wherein a separated enclosed space (14) is furnished, formed by the frame (1) following to an end (13) of the paper guide (9; 9*a*), to the print substrate support (3), and to the longitudinal guide (4) for the print head slider (7), respectively, wherein at least one printed circuit board for a control-unit (15), an interface printed circuit board (16), and the paper guide drive motor (10), as well as the print head slider drive motor (11) are disposed in the separated enclosed space (14).

20. The printer according to claim 19, wherein the separated enclosed space (14) is shielded with a sheet-metal casing (17) shielding to the outside against interfering radiation.

21. The printer according to claim 19, wherein a frame side wall (1*a*), made of electrically conductive plastic, is disposed toward the paper guide (9; 9*a*), toward the print substrate support (3), and toward the longitudinal guide (4) for the print head slider (7), respectively, and wherein the longitudinal guide (4) comprising a guide rod (5) supporting the print head slider and an axle (6) supporting the print head slider are electrically conductively supported in the frame wall (1*a*), and wherein the print substrate support (3) is supported in the frame wall (1*a*).

22. The printer according to claim 19, wherein the separated enclosed space (14) is shielded against interfering radiation and is subdivided into several levels (19, 20), wherein an interface printed circuit board (16) and a control-logic printed circuit board (15) are disposed at one level (19), and wherein the interface printed circuit board (16) and the control-logic printed circuit board (15) are functionally connected by way of a connection plug (21).

23. The printer according to claim 19, further comprising a guide (23) for the interface printed circuit board interface printed circuit board attachment means attached to the frame, wherein the interface printed circuit board (16) is withdrawn and reinserted, respectively, in a sideways direction and in rearward direction, respectively, along the guide (23) from the interface printed circuit board attachment means.

24. The printer according to claim 21, wherein the paper guide drive motor (10) is supported at the frame side wall (1*a*) made of an electrically conductive plastic.

25. The printer according to claim 21, further comprising a printed circuit board (38) for an electronic power supply unit, wherein electrical connection terminals (34*a*, 35; 36, 37) for the paper guide drive motor (10) and for the print head slider drive motor (11) are led to the printed circuit board (38) for the electronic power supply unit disposed in the area of the frame side wall (1*a*) of the separated enclosed space (14).

26. The printer according to claim 19, wherein a main power supply connection (43) is disposed at a rear wall side (46) of the separated enclosed space (14).

27. The printer according to claim 26 wherein a plug contact strip (18) for the interface printed circuit board (16) and a main power supply cable (47) are disposed at the rear wall side (46) of the separated enclosed space (14).

28. The printer according to claim 19, wherein a keyboard (48) is disposed adjacent to the separated enclosed space (14).

29. The printer according to claim 28, wherein the keys (49) of the keyboard (48) protrude through openings (50) of the plastic casing (12).

30. The printer according to claim 29, wherein the plastic casing is a multiple-part plastic casing.

31. The printer according to claim 29, wherein the casing is a two-part casing.

32. The printer according to claim 19, wherein the paper guide is a single-sheet paper guide.

33. The printer according to claim 19, wherein the paper guide is a continuous-paper-web paper guide.

* * * * *